US005924500A

United States Patent [19]

Puttmann

[11] Patent Number: 5,924,500

[45] Date of Patent: Jul. 20, 1999

[54] STEERABLE BORING MACHINE

[75] Inventor: Franz-Josef Puttmann, Lennestadt, Germany

[73] Assignee: Tracto-Technik, Paul Schmidt, Spezialmaschinen, Lennenstadt, Germany

[21] Appl. No.: 08/861,424

[22] Filed: May 21, 1997

[30] Foreign Application Priority Data

May 21, 1996 [DE] Germany ..... 196 20 401

[51] Int. Cl.[6] ..... E21B 7/04; E21B 1/02

[52] U.S. Cl. ..... 175/61; 175/73; 175/170; 175/173

[58] Field of Search ..... 175/61, 73, 170, 175/173

[56] References Cited

U.S. PATENT DOCUMENTS

| | | | |
|---|---|---|---|
| 3,878,903 | 4/1975 | Cherrington . | |
| 4,013,134 | 3/1977 | Richmond et al. . | |
| 4,058,176 | 11/1977 | Fischer et al. | 175/61 |
| 4,597,454 | 7/1986 | Schoeffler . | |
| 4,699,224 | 10/1987 | Burton | 175/61 |
| 4,848,486 | 7/1989 | Bodine | 175/55 |
| 4,948,925 | 8/1990 | Winters et al. | 175/48 |
| 5,392,868 | 2/1995 | Deken et al. . | |
| 5,421,420 | 6/1995 | Malone et al. . | |
| 5,449,046 | 9/1995 | Kinnan | 175/24 |
| 5,484,029 | 1/1996 | Eddison . | |
| 5,738,178 | 4/1998 | Williams et al. | 175/61 |

FOREIGN PATENT DOCUMENTS

| | | |
|---|---|---|
| 0 195 559 | 9/1986 | European Pat. Off. . |
| 0 204 474 | 12/1986 | European Pat. Off. . |
| 0 247 767 | 12/1987 | European Pat. Off. . |
| 0 674 093 | 9/1995 | European Pat. Off. . |
| 2 185 767 | 7/1987 | United Kingdom . |
| WO 89/10467 | 11/1989 | WIPO . |
| WO 93/10326 | 5/1993 | WIPO . |

*Primary Examiner*—Thomas B. Will
*Assistant Examiner*—Gary S. Hartmann

[57] ABSTRACT

With a boring machine having a multistrand rod assembly (3) for producing boreholes in the ground, comprising a rotatable inner rod (29), an outer rod (19), at least one steering and digging tool (5; 33, 35, 36) driven by the inner rod and having an axis of rotation (22) inclined at an angle of for example 90° to the axis of the rod (23), and a linear drive for the rod assembly (3, 19, 20), it is possible to perform both straight-ahead boring and, if only the steering and digging tool is driven, curve boring.

18 Claims, 6 Drawing Sheets

STEERABLE BORING MACHINE

FIELD OF THE INVENTION

The invention relates to a steerable boring machine by means of which boreholes can be made in the ground both straight ahead and along a curved path, as desired.

BACKGROUND OF THE INVENTION AND PRIOR ART

Such boring machines comprise a drill rod with a rotary and/or percussion or vibratory drive and with a very wide variety of drill heads. The drill rod is usually mounted on a carriage guided on rails and connected to a linear drive and has a rotary or rotary/percussion drive by means of which the rod can be caused to rotate and optionally also be forced into the ground.

There are various methods and machines for directional boring in soft ground, in most of which a rotatably mounted drill rod carries a drill head having a steering face inclined to the axis of the rod, According to EP-A 0 195 559 such drill heads may also be provided with cutting jet nozzles. When the rod is rotating, i.e. when boring straight ahead, both the steering head and the cutting jets dig into the ground, insofar as it is sufficiently workable. With hard ground, and particularly in rock formations, this is not the case, since the cutting jets then lose their digging power and the steering face remains ineffective.

In order to initiate a curve boring with the known device the rotation of the drill head is interrupted and the drill head, still subjected to a forward driving force, is deflected, depending on the inclination of the steering face relative to the axis of the rod, to the side opposite the steering face. As soon as the desired curved path has been traversed, the drill head is again caused to rotate, thereby neutralising the deflecting action of the inclined face. This is also done for a short time if a correction of the curved path is found to be necessary.

Moreover, cutting-jet drilling also suffers from the disadvantage that as a result of the high fluid pressure washouts and consequent cave-ins may occur.

It is generally necessary to adjust the angular position of the drill head repeatedly in this way in the course of a (fairly long) curve. Hence the rod, which is otherwise not rotating as it follows a curve, always has to take a plurality of angled steps. This results in a zigzag or corkscrew-shaped borehole in the ground, but no precise curved path.

The angular position of the inclined face of the drill head at any time depends on the direction of curvature of the borehole to be produced, but the inclined face is always on the inside of the curved path, where it acts in effect like a pivot, while as the rod or the drill head is driven forward mechanically by pushing and/or striking but without rotation the opposite side to the inclined face acts in the ground as a shoulder or guide shoe sliding along a guide plank. During the rotation-free curve boring the soil in front of the drill head is forced aside by the drill head and/or is excavated to a greater or less extent by means of a sharp jet of fluid. However, this is only possible in the case of soils that are not too hard and are free from obstructions, and can also be forced aside.

This procedure, however, fails in rock formations, since during the curve boring the drill head does not rotate and is advanced only by pushing. Hard soils and rock formations therefore require boring machines having digging or cutting tools which are driven independently of any rotation of the drilling head and which permit mechanical excavation of the ground during the curve boring, i.e. when the drill head is not rotating.

A machine of this kind is known from U.S. Pat. No. 3,878,903. This machine has a single-strand rod having a mud motor driving the digging tool. This motor is driven by a fluid supplied through the hollow rod, which normally passes out of the drill head into the ground and is then lost.

Boring systems are also known in which the driving fluid is returned and re-used. In each case, however, having regard to the high speed of rotation and a correspondingly high torque at the digging tool, large amounts of fluid are required, which must be made available, pumped round, returned and recycled or disposed of.

A further disadvantage of these machines is that because of lack of space in the drill head the size of the motor and consequently the driving power is limited. Moreover in case of damage to the mud motor the whole drill rod must be withdrawn in order to remove or repair the motor. In the case of boreholes 200 m or more in length this takes a great deal of time and leads to correspondingly long interruptions in the operation.

EP-A 0 247 767 also describes a drill head connected to a rotary/thrust rod and having an inclined face which permits straight-ahead boring so long as the drill head rotates uniformly, and in the absence of rotation curve boring by lateral displacement of the soil located in front of the drill head.

The process concerned here, however, is purely one of displacement, which is quite unsuitable for hard and rocky ground formations and in addition, because of the lateral displacement of the ground surrounding the borehole, can lead to damage to other supply lines or at the surface, for example to road surfaces. Accordingly, when boring with such machines it is always necessary to maintain an adequate margin of safety.

The known steerable boring machines having a digging tool driven via an inner rod share the constructional feature that the tool is in the form of a face tool and has an axis of rotation which is either parallel to or is inclined at a more or less acute angle to the axis of rotation of the rod. The radius of curvature when curve boring is therefore fixed once for all: it is always determined by the eccentricity or the inclination of the axis of rotation of the tool relative to the axis of rotation of the rod. Curve boring with a particular radius of curvature therefore requires a correction of the respective angular setting of the eccentricity and therefore necessarily results in a zigzag or corkscrew-shaped borehole, since in describing a curve numerous corrective changes in the angular setting of the eccentricity are needed.

This has an extremely adverse effect when subsequently widening the pilot bore by means of an enlarging head and/or drawing a pipeline into the pilot bore, since precisely in the particularly critical curve region the borehole follows an irregular course and has nonuniform walls, which present a high frictional resistance to the enlarging head and/or to the pipe which is being drawn in. This requires increased technical outlay when enlarging and drawing-in. Added to this is the instability of such borehole walls, which is associated with the risk of cave-ins, which increase the difficulties in widening the borehole and drawing in pipes, and in particular gives rise to the risk of damage to the pipe as it is drawn in.

A further European patent application, EP-A 0 674 093, describes a steerable boring machine with an eccentrically disposed drill head. This drill head is driven via an inner rod disposed in an outer pipe. The outer pipe is connected to a rotary drive and has a sliding block or shoe fitted on to it at its front end which forces the drill head to one side, i.e. into a curved course, in the event of interruption of the rotation of the outer pipe. However, associated with the sliding block comes the disadvantage of non-uniformity in the walls of the borehole, which can lead to difficulties in the introduction of a product pipe into the borehole and also to caving in of the soil.

Generally speaking, in the known boring machines the driven tool is primarily designed for curve boring: substantially exact straight-ahead boring is therefore in most cases not possible, so that also in the case of straight-ahead boring directional corrections are needed from time to time. Consequently in straight-ahead boring a more or less pronounced zigzag course of the borehole results, which can lead to great difficulties when introducing a product pipe, for example as a follower pipe.

OBJECT OF THE INVENTION

It is therefore an object of the invention to provide a machine and process which allows of a change in direction which is both smooth and also is kind to the rod and to the drill head, and which results in a uniform curvature in the curve region and in a borehole with the smoothest possible walls even in the case of straight-ahead boring.

SUMARY OF THE INVENTION

With this end in view, the invention is based on the concept of dynamic control of the curve boring by means of the digging power of at least one steering and digging tool located at the head of the drill rod assembly and having its own drive.

This makes it possible to provide a boring machine having a multi-strand rod assembly comprising an inner rod, a preferably rotatable outer rod and at least one steering and digging tool which is driven by an inner rod and has its axis of rotation extending at a preferably obtuse angle, for example of 90°, to the axis of the rod or to the axis of rotation of the rod, and a linear drive for the drill rod. The digging tool may be disposed in front of or beside the rod, or else two tools, preferably having a common axis of rotation and in particular being of the same kind, may be disposed one on either side of the head of the drill rod.

The multistrand rod assembly can be made up of concentric pipes, optionally with a central shaft rod for the steering and digging tool. The number of individual strands running to the rotary drive for the rods will depend on the individual case. The only deciding factor is that the digging power of the steering and digging tool must be adjustable independently of the rotary drive of the rod.

In straight-ahead boring with a digging tool the drill rod rotates and thereby cancels out the effect of the eccentricity of the digging tool provided with a drive of its own. In order to initiate boring along a curve, the rotation of the rod is interrupted and the digging tool is brought into a particular angular position which is determined by the direction of curvature of the intended curved path. The tool is always on the inner side of the curved path, where it works the soil, while the rod is pushed or driven forward linearly. The radius of curvature of the curved path is determined by the rate at which the ground is dug or worked, i.e. ultimately by the speed of rotation of the digging tool: the higher the speed of rotation, the tighter is the curvature of the curved path. In this way, by the choice of the speed of rotation of the digging tool, the radius of curvature can be determined and, if necessary, corrected by a change in the speed as the curve is described. This results in a substantially uniform curvature and a smooth-walled borehole.

If two tools are arranged at the head of the rod, for example opposite to one another, curve boring in the manner described above is possible if the tool located on the inner side of the curve exerts greater digging power than the other digging tool, the digging power of which may be zero.

Constant rotation of the rod during straight-ahead boring with two tools is not necessary if the digging power of the two tools is substantially the same. In this way the two tools neutralise one another so long as substantially the same working conditions obtain on both sides of the rod assembly. In the case of curve boring it is only necessary to change the speed or direction of rotation of one of the two tools. The tool with the higher speed of rotation then forms in practice a pivot for the driving forward of the rod and, as it were, pulls the rod into the curve which is bent to its side.

The steerability can also be improved by spacing the axis of rotation of the tool or tools from the axis of rotation of the rod, thereby creating an additional eccentricity.

The head of the rod assembly can be in the form of a tool, so that straight-ahead and curve boring is possible by means of the head of the rod assembly as it moves forward.

In order to cool and lubricate the tool and to facilitate the removal of the spoil the rod assembly may be provided with a channel through which a liquid or a gas is supplied to a nozzle located at the head of the rod assembly. This nozzle can be located in an inclined steering face on the head of the rod assembly which is located opposite the digging tool and acts as a skid or guide plank when describing a curve.

A particularly suitable form of tool drive is bevel gearing, by means of which with little outlay two tools disposed opposite one another can be driven with the same angular velocity. Alternatively, however, a driving chain can run over a chain wheel fitted on the tool shaft and a chain wheel driven by the bevel gearing. This chain can be fitted with tools, preferably hard metal teeth, which project on one side beyond the periphery of the rod assembly, and then acts in a similar way to a coal plane. Such a chain permits particularly rapid removal of the spoil excavated from the region of the head of the rod, for example to clearing openings in the outer rod.

A dynamic control of the curve boring by means of the digging power is possible both with rotating rods and with non-rotating rods, since the steering and digging tool has a drive of its own, independent of the rotary drive of the rod assembly. This drive, for example, permits the speed of rotation of the steering and digging tool to be varied, preferably periodically, in order, by means of a targeted change in speed of rotation, taking into consideration the radius of curvature, the length and the direction of curvature, to increase or reduce the digging power on one side of the drill head so as to steer the movement of the drilling head in one direction or the other with reference to the axis of the rod. Thus, depending on the ground conditions, by an increase in the digging power on one side of the drill head the drill head can be moved in the direction of the other side, or by a decrease in the digging power it can be moved in the direction of the tool side of the drill head.

Another possibility consists in changing the direction of rotation of the tool so as to effect an increase or a decrease in the digging power on one side of the drill head and accordingly to bring about curve boring in one direction or the other. The same effect can be achieved if by means of two tools disposed opposite to one another the digging power is increased on one side of the drill head and is reduced on the other side of the drill head.

A further possible way of influencing the digging power at the drill head consists in moving the digging tool out of an opening in the rod to a greater or less extent and in this way increasing or decreasing the depth of engagement of the tool in the ground.

Since in all the variants of the process the possibility exists of changing the digging power continuously, the process in accordance with the invention permits very sensitive control which leads to a very exact maintenance of the intended curved path. In particular this is possible when a transmitter is fitted in the drill head to provide signals which are passed on via an above-ground receiver to the controls of the tool and of the rotary drive.

BRIEF DESCRIPTION OF THE DRAWINGS

The invention will now be described in more detail by way of example with reference to embodiments shown in the drawings, in which.

DETAILED DESCRIPTION OF PREFERRED EMBODIMENTS OF THE INVENTION

Figure 1:
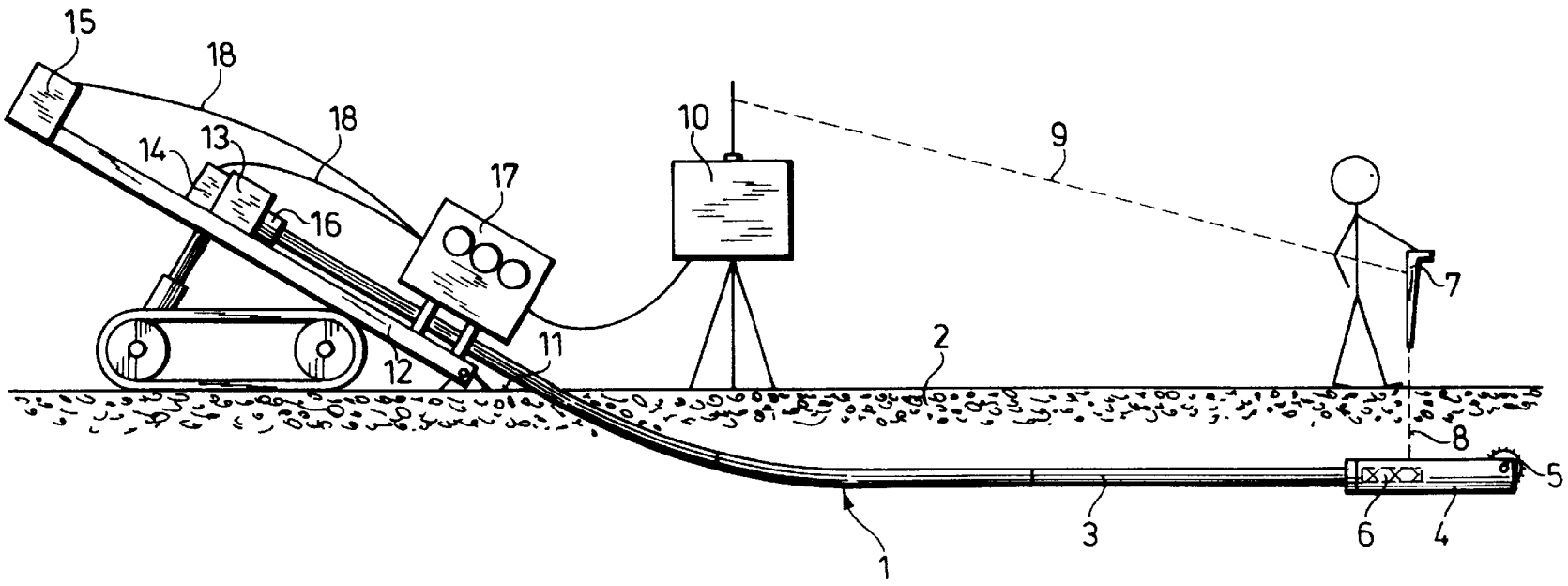
FIG. 1 shows diagrammatically a boring machine in accordance with the invention.

In accordance with the process of invention the boring machine is used to produce a borehole 1 in the ground 2 by means of a flexible drill rod assembly 3 made up of individual pipes. At the end of the drill rod assembly 3 there is a drill head 4 having a digging tool 5 disposed beside it which is connected to an outer hollow rod or pipe of the drill rod assembly 3. When the rod assembly is rotated the tool 5 describes an envelope circle around the rod axis. A transmitter 6 is fitted in the drill head 4 which transmits by radio to a receiver 7 data relating to the depth of the drill head 4 below the surface of the ground, the location of the drill head 4 in the ground, its inclination, the angular position of the steering face 5 with respect to the longitudinal axis of the drill head 4 and optionally the temperature at the drill head. A radio connection between the transmitter 6 and a receiver 7 is indicated by the broken line 8.

A further radio connection 9 communicates the above-mentioned data from the receiver 7 to an indicating device 10 in the vicinity of a percussive rotation and feed unit 12 disposed at the start 11. This rotation and feed unit 12 includes a rotary drive 13 for the drill rod 3, a percussion device 14 striking the drill rod 3 and a feed device 15. The drill rod 3 is coupled to the rotation and feed unit by way of a drill rod connection 16.

From the indicating device 10 a cable connection leads to a circuit box 17 with an operating desk, by means of which it is possible, through a respective cable connection 18, to control the rotary drive 13, the percussion device 14 and the feed drive 15.

The machine shown in FIG. 1 can be driven in two different ways. If the drill rod assembly 3 is driven through the ground 2 by rotation and thrusting a straight borehole is obtained. The deflection of the eccentrically acting drill head 4 which is possible on account of the eccentrically mounted tool 5 on the drill head is neutralized through the uniform rotation of the drill rod 3.

The tool 5 is formed as a roll and is fitted at the head of a rod assembly 3 comprising an outer hollow rod or pipe 19 and an inner rod 20: it is fitted in a slit 21 in the outer pipe 19 and projects slightly forward from and to one side of the head of the rod assembly.

The axis of rotation 22 of the tool is thus spaced from the rotational and longitudinal axis 23 of the drill rod.

The front end of the inner rod 20 is fitted in a collar 24 of the outer pipe 19 and is formed as a bevel gearwheel 25: it meshes with a bevel gearwheel 27 carried on a cross-shaft 26. The cross-shaft 26 and the tool shaft 28 are each formed as chain wheels and are drivably connected to one another by a circulating chain 29.

Figure 3:
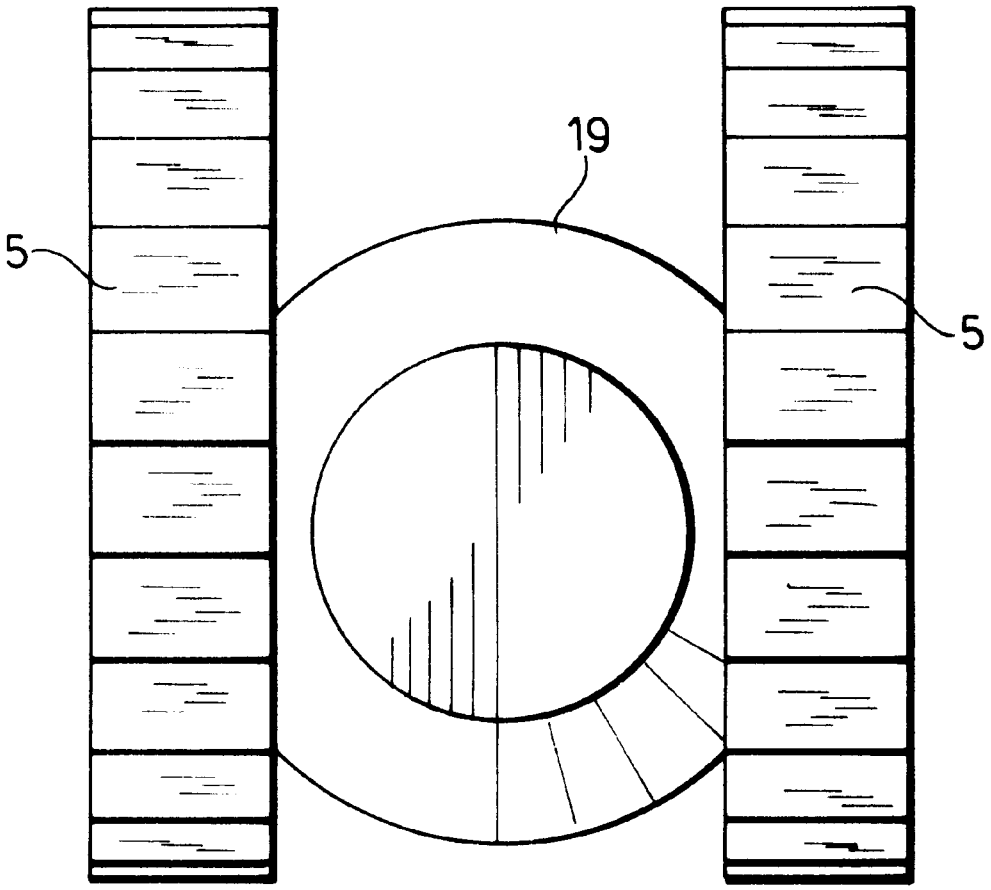
FIG. 3 is the end view of a rod assembly similar to that shown in FIG. 2, but with the addition of a further digging tool.

The tool need not be located in a slit in the head of the drill rod assembly, but may alternatively be located outside the outer pipe 19. Thus it is also possible, for example as shown in FIG. 3, for two tools 5 to be disposed opposite one another on the head of the rod assembly. These tools can be driven in common or separately, as desired, in order to make straight-ahead boring and curve boring possible.

Figure 2:
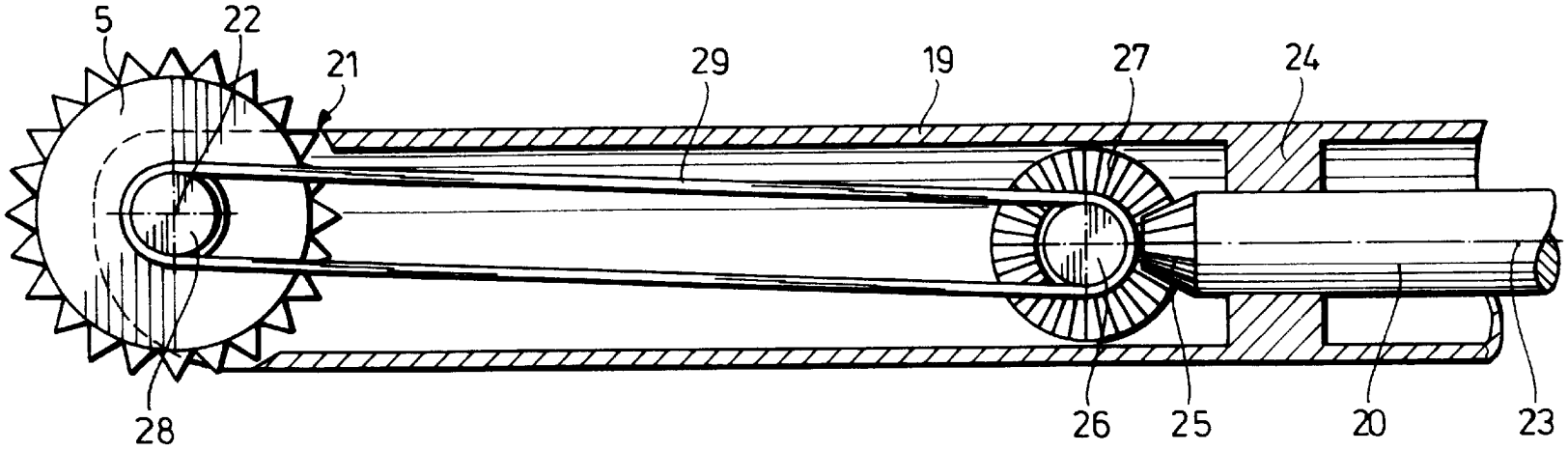
FIG. 2 shows in longitudinal axial section a drill rod assembly having a digging tool located in the middle.
Figure 4:
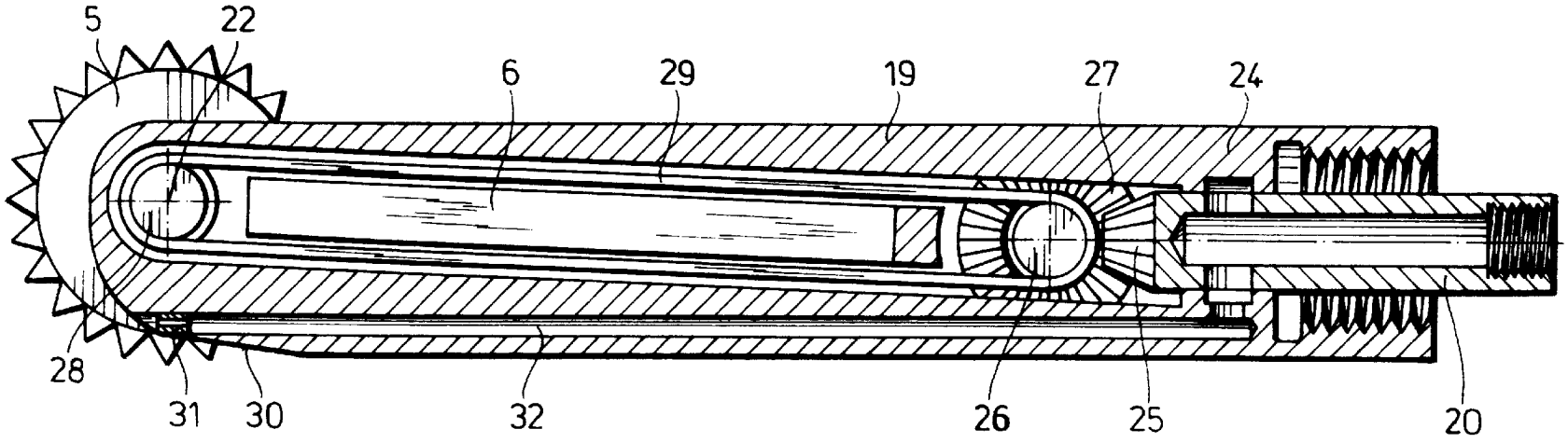
FIG. 4 shows a tubular rod assembly for fluid-assisted boring.

The device shown in FIG. 4 corresponds essentially to that shown in FIG. 2, but with a drill head which, as shown in FIG. 3, is equipped with two lateral digging tools 5 which are carried on a common shaft 28 and therefore have the same direction and speed of rotation. However, it is also possible for both of these tools to be driven directly from the inner rod, each through a respective bevel gearwheel. They then rotate in different directions.

Figure 5:
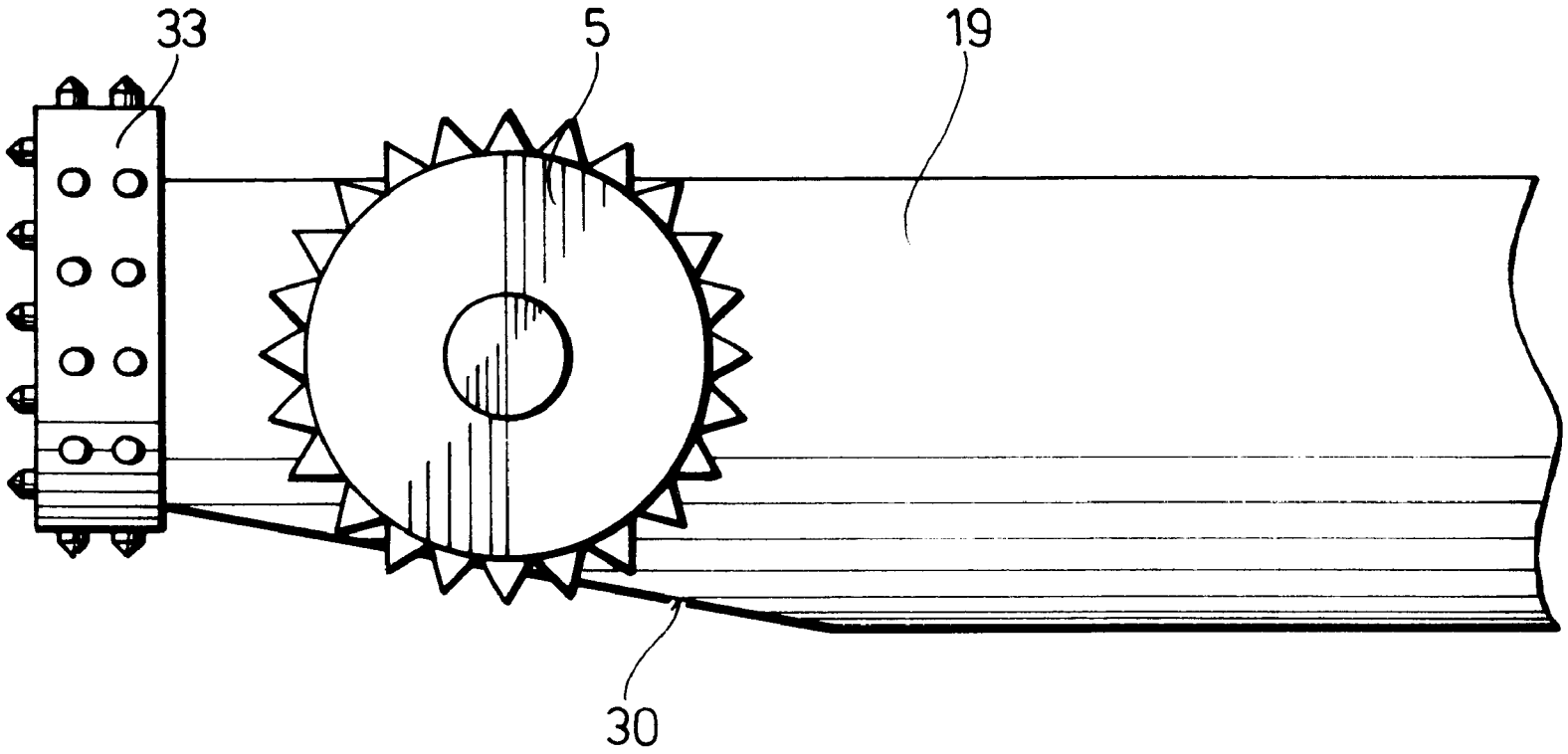
FIG. 5 shows a drill rod assembly with a rod head which advances in front of it.

The outer pipe 19 is provided, as shown in FIG. 4. with a steering incline formed by a steering face 30 in which there is a nozzle 31, which is supplied via a passage 33 with drilling fluid or a gas. The drill head shown in FIG. 5 has a similar structure, but it projects some distance beyond the two laterally arranged tools and is provided with a rotatable tool 33, likewise with an eccentric axis of rotation. The tool 33 can likewise be driven from the inner rod, for example through bevel gearing.

Figure 6:
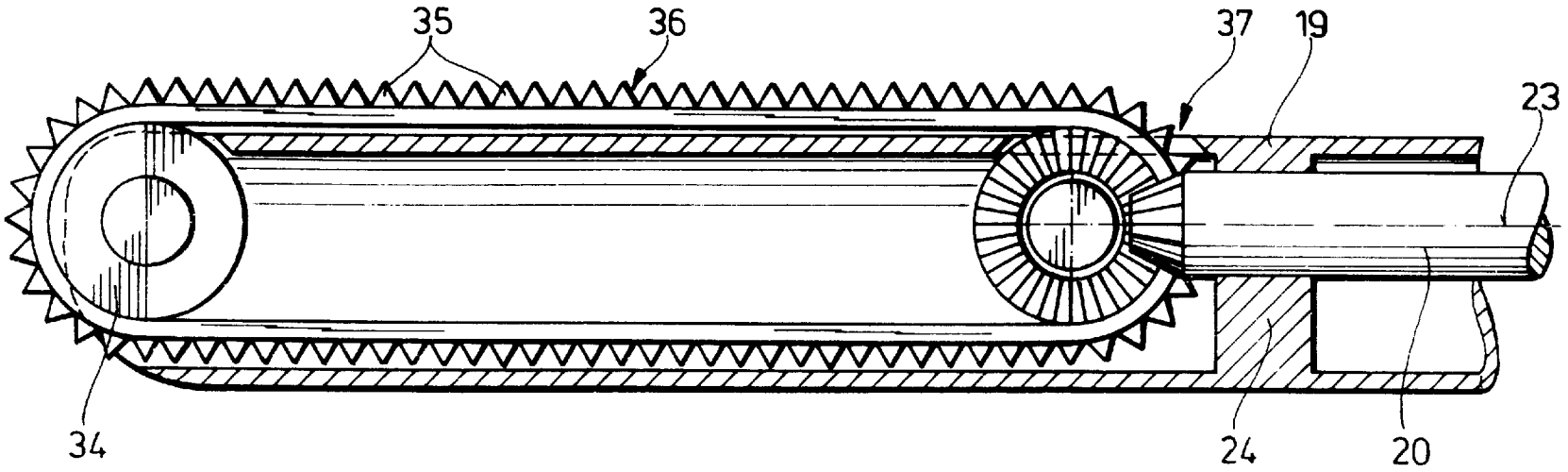
FIG. 6 shows a drill rod assembly with a digging tool like a coal plane.

In the embodiment shown in FIG. 6 the inner rod 20 is mounted eccentrically in the collar 24 of the outer pipe 19 and drives a circulating chain 36 passing over a front wheel 34 and set with tools 35, which projects to one side and forwards from a slit 37 in the outer pipe 19 and acts like a coal plane or a trench cutting machine.

In straight-ahead boring the outer pipe acting as tool carrier rotates and therefore exerts the directing action of the eccentrically disposed and acting tools 5, 33, 35, 36. For curve boring the tool is brought by means of the outer pipe into a desired angular position in which it remains until the intended curve has been traversed or the course of the curve requires correction by a slight change in the angular position.

In the embodiment of FIG. 3 straight-ahead boring is possible even without rotation of the outer pipe if the two oppositely disposed tools are driven with the same speed of rotation. For curve boring the two tools are driven at different rotational speeds and a curve results which is curved to the side of the digging tool that is working harder. The tools can also be arranged so that they can be moved transverse to the axis of the rod or in the direction of the rod axis, in order to influence the steering action by displacement of the tool.

What is claimed is:

1. A boring machine for the production of bore holes in the ground, comprising:

a multi-strand rod assembly comprising a rotatable inner member and a rotatable outer member;

a steering and digging tool carried by the rod assembly and driven by the rotatable inner member;

a first drive system providing rotational and linear movement for the rotatable outer member; and a second drive system, for rotating the rotatable inner member independently of the rotation of the outer member, whereby steering of the boring machine is effected by varying the driving of the rotatable inner member.

2. A boring machine according to claim 1, wherein the steering and digging tool is rotatable and an axis of rotation of the steering and digging tool is offset from an axis of rotation of the rotatable outer member.

3. A boring machine according to claim 2, wherein the rotatable outer member is provided with a steering incline at a position opposite to the axis of rotation of the steering and digging tool with respect to the axis of rotation of the rotatable outer member.

4. A boring machine according to claim 3, further comprising a nozzle located on the steering incline and a channel in the rotatable outer member leading to the nozzle.

5. A boring machine according to claim 1, wherein the steering and digging tool is positioned in a slit in the rotatable outer member.

6. A boring machine according to claim 1, comprising a pair of steering and digging tools positioned at opposed sides of the rotatable outer member.

7. A boring machine according to claim 1, wherein the steering and digging tool is located at a position to the rear of a forward end of the rotatable outer member.

8. A boring machine according to claim 7, further comprising a digging member at the forward end of the rotatable outer member.

9. A boring machine according to claim 1, further comprising a nozzle for the rotatable outer member and a channel in the rotatable outer member leading to the nozzle.

10. A boring machine according to claim 1, further comprising bevel gearing for transmitting driving power between the rotatable inner member and the steering and digging tool.

11. A boring machine according to claim 10, further comprising a tool shaft for the steering and digging tool, a first chain wheel carried on the tool shaft, a second chain wheel carried on the bevel gearing and a chain running over the first second chain wheels.

12. A boring machine according to claim 11, wherein the chain is provided with digging elements and the steering and digging tool comprises said chain.

13. A boring machine according to claim 12, wherein the chain runs in a longitudinal slit in the rotatable outer member.

14. A boring machine according to claim 1, wherein the boring machine carries out boring in a straight line with rotation of the rotatable outer member, and carries out boring in a curved path without rotation of the rotatable outer member.

15. A method of directed boring of a bore hole in the ground, comprising:

boring a bore hole with a boring machine comprising a multi-strand rod assembly comprising a rotatable inner member and a rotatable outer member; a steering and digging tool carried by the rod assembly and driven by the rotatable inner member; a first drive system providing rotational and linear movement for the rotatable outer member; and a second drive system, for rotating the rotatable inner member independently of the rotation of the outer member; and adjusting rotation of the rotatable inner member to vary a digging power of the steering and digging tool to change a direction of boring.

16. A method according to claim 15, wherein the steering and digging tool is rotatable and the digging power is varied by changing the speed of rotation of the steering and digging tool.

17. A method according to claim 15, wherein the steering and digging tool is rotatable and the direction of rotation of the steering and digging tool is changed.

18. A method according to claim 15, wherein the rotatable outer member is rotated to carry out straight line boring and the rotatable outer member is not rotated to carry out boring in a curved path.

* * * * *